United States Patent [19]

McQueen

[11] 4,167,219

[45] Sep. 11, 1979

[54] VISCOUS PUMP ROCK BIT LUBRICATION SYSTEM

[75] Inventor: Robert W. McQueen, Houston, Tex.

[73] Assignee: Dresser Industries, Inc., Dallas, Tex.

[21] Appl. No.: 936,554

[22] Filed: Aug. 24, 1978

[51] Int. Cl.[2] ..... E21B 9/08

[52] U.S. Cl. ..... 175/229; 175/372; 308/8.2; 175/337

[58] Field of Search ..... 175/228, 229, 337, 371, 175/372; 308/8.2

[56] References Cited

U.S. PATENT DOCUMENTS

| | | | |
|---|---|---|---|
| 1,010,143 | 11/1911 | Hughes | 175/228 |
| 3,244,459 | 4/1966 | Ortloff | 308/8.2 |
| 3,251,634 | 5/1966 | Dareing | 308/8.2 |
| 3,659,663 | 5/1972 | Dysart | 175/337 X |
| 3,841,422 | 10/1974 | Crow | 175/229 |
| 3,844,364 | 10/1974 | Crow | 175/228 |

*Primary Examiner*—James A. Leppink
*Assistant Examiner*—Richard E. Favreau
*Attorney, Agent, or Firm*—Eddie E. Scott

[57] ABSTRACT

Lubricant is circulated from a lubricant reservoir to the bearings of a rotary rock bit and back to the lubricant reservoir by a lubricant circulation system that is operated by rotation of the cone cutter upon the bearing pin of the bit. A spiral groove system in the inner surface of the cone cutter operates as a viscous or ram pump when the cone cutter is rotating against the corresponding bearing surface of the bearing pin and provides the pumping action for circulating the lubricant. A seal is positioned between the rolling cone cutter and the arm of the bit to maintain lubricant in the bearing area and to prevent fluid in the borehole from entering the bearing area. A lubricant reservoir is located in the bit body. A first passage connects the lubricant reservoir with the bearing area to channel lubricant from the lubricant reservoir to the bearing area. A second passage extends from the bearing area to the lubricant reservoir to allow lubricant to be channeled back to the lubricant reservoir. A spiral groove system in the bearing surface of the cone cutter operates as a viscous or ram pump when rotating against the corresponding bearing surface of the bearing pin providing a pumping action to circulate lubricant from the lubricant reservoir through said first passage to the bearing area and from the bearing area through said second passage back to the lubricant reservoir.

3 Claims, 5 Drawing Figures

VISCOUS PUMP ROCK BIT LUBRICATION SYSTEM

TECHNICAL FIELD

The present invention relates to the art of earth boring and, more particularly, to a rolling cutter earth boring bit with a system for circulating lubricant from a lubricant reservoir to the bearing area and back to the lubricant reservoir. The present invention is especially adapted for use with rock bits popularly known as three cone rotary rock bits; however, its use is not restricted thereto, and the present invention can be used in other types of rotary rock bits.

BACKGROUND OF THE INVENTION

A three cone rotary rock bit consists of a main bit body adapted to be connected to a rotary drill string. The bit includes three individual rotatable cone cutters mounted on three individual bearing pins extending from the main bit body. Bearing systems are provided between the cone cutters and the bearing pins to promote rotation of the cutters and means are provided on the outer surface of the cone cutters for disintegrating the earth formations as the bit and the cutters rotate. A supply of undeteriorated lubricant must be maintained proximate the bearing systems throughout the lifetime of the bit. By circulating the lubricant from a reservoir to the bearings and back to the reservoir, the life of the lubricant will be increased and a larger volume of lubricant will be exposed to the bearing surfaces.

A three cone rotary rock bit must operate under very severe conditions, and the size and geometry of the bit is restricted by the operating characteristics. At the same time, the economics of petroleum production demand a longer lifetime and improved performance from the bit. In attempting to provide an improved bit, new and improved materials have been developed for the cutting structure of the cone cutters. They have provided a longer useful lifetime for the cone cutters. This has resulted in the bearing systems of the bit being often the first to fail during the drilling operation. Consequently, a need exists for new and improved lubrication systems and bearing systems to extend the useful lifetime of the bit and to allow development of other elements that interact with the lubrication and bearing systems. In attempting to provide a new lubrication system, great care must be taken that the overall capacity of the bearing systems is not reduced.

DESCRIPTION OF PRIOR ART

In U.S. Pat. No. 3,244,451 to J. E. Ortloff, patented Apr. 5, 1966, a lubricating system for extending the life of the bearings of a roller cone type bit is shown. Sealing means are provided to effectively separate or close off the clearance between the journal of the leg and the bearings of the roller cone from the exterior of the bit. A special pump means is provided to circulate the lubricating fluid under high pressure through this sealed-off clearance space. The pump means is actuated by the rotation of the roller cone element on the shaft.

In U.S. Pat. No. 3,251,634 to W. D. Dareing, patented May 17, 1966, a lubricating system for extending the life of the bearings of a roller cone type bit is shown. Sealing means are provided to effectively separate or close off the clearance or space between the journal of the leg and the bearings of the roller cone from the exterior of the bit. An electrical pump means is provided to supply a lubricating fluid under high pressure to this sealed-off clearance space.

In U.S. Pat. No. 3,841,422 to M. L. Crow, patented Oct. 15, 1974, a dynamic rock bit lubrication system is shown. Lubricant is circulated from a lubricant reservoir to the bearings of a rotary rock bit and back to the lubricant reservoir by a lubricant circulation system that is operated by movement of the cone cutter upon the bearing pin of the bit. A positive seal is positioned between the rolling cone cutter and the arm of the bit to maintain lubricant in the bearing area and to prevent fluid in the borehole from entering the bearing area. A lubricant reservoir is located in the bit body. A first passage connects the lubricant reservoir with the bearing area to channel lubricant from the lubricant reservoir to the bearing area. A second passage extends from the bearing area to the lubricant reservoir to allow lubricant to be channeled back to the lubricant reservoir. A check valve in at least one of said passages insures one-way flow of lubricant. Axial movement of the cone cutter on the bearing pin provides a pumping action to circulate lubricant from the lubricant reservoir through said first passage to the bearing area and from the bearing area through said second passage back to said lubricant reservoir.

In U.S. Pat. No. 3,844,364 to M. L. Crow, patented Oct. 29, 1974, a hydrostatic rock bit lubrication system is shown. Lubricant is circulated from a lubricant reservoir to the bearings of a rock bit and back to the lubricant reservoir by a lubricant pump that is operated by periodic fluid pressure variations. A pumping chamber is located in the bit body. A movable pumping element is positioned in the pumping chamber. A first side of the pumping element is exposed to the pressure of the drilling fluid. Passages are provided to channel the lubricant from the lubricant reservoir to the bearing systems and back to the lubricant reservoir. The second side of the pumping element is exposed to lubricant in the passages. Check valves in the passages provide oneway flow of lubricant. Periodic pressure variations in the drilling fluid create a reciprocating motion of the pumping element causing the lubricant to be circulated through the passages.

SUMMARY OF THE INVENTION

The present invention provides a lubricant circulation system for a rotary rock bit. Pumping grooves in the bearing surface of the rotating cone cutter continuously circulate lubricant from a lubricant reservoir through the bearing area and back to the reservoir in a closed system. A seal is positioned between the rolling cone cutter and the arm of the bit to maintain lubricant in the bearing area and to prevent fluid and materials in the borehole from entering the bearing area. A lubricant reservoir is located in the bit body. A first passage connects the lubricant reservoir with the bearing area to channel lubricant from the lubricant reservoir to the bearing area. A second passage extends from the bearing area to the lubricant reservoir to allow lubricant to be channeled back to the lubricant reservoir. A spiral groove system in the bearing surface of the cone cutter operates as a viscous or ram pump when rotating against the corresponding bearing surface on the bearing pin providing a pumping action to circulate lubricant from the lubricant reservoir through said first passage to the bearing area and from the bearing area through said second passage back to said lubricant reservoir. The above and other features and advantages of the present invention will become apparent upon consideration of the following detailed description of the invention when taken in conjunction with the accompanying drawings.

DETAILED DESCRIPTION OF THE INVENTION

Figure 1:
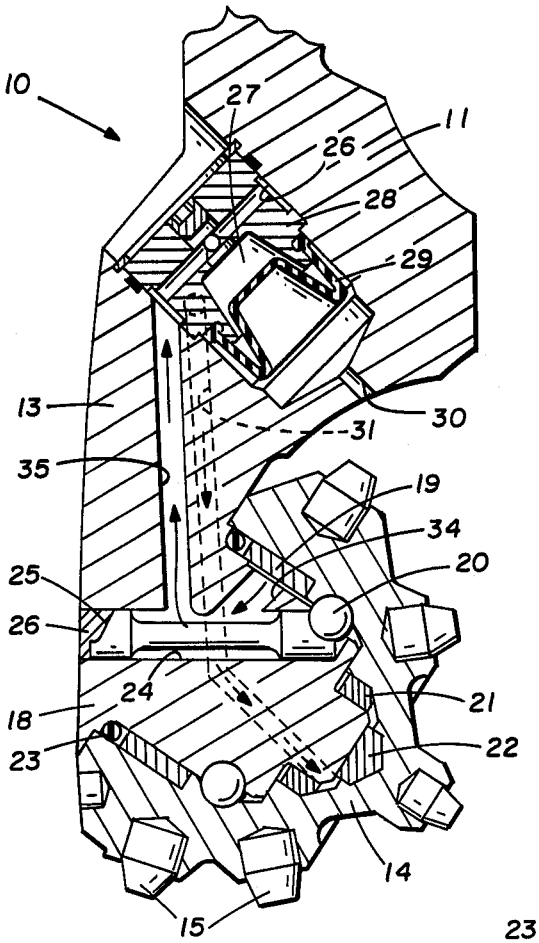
FIG. 1 is a sectional view of one arm of an earth boring bit constructed in accordance with the present invention.

Referring now to FIG. 1, a sectional view of one arm 13 of a three cone rotary rock bit 10 is shown. It is to be understood that the structures of the other two arms are substantially identical to the arm 13. A cutter 14 is rotatably positioned on the journal portion or bearing pin 18 of the arm 13 and adapted to disintegrate the earth formations as the bit 10 is rotated. The cutting structure 15 on the surface of cutter 14 contacts and disintegrates the formations in a manner that is well known in the art. The cutting structure 15 is shown in the form of tungsten carbide inserts. However, it is to be understood that other cutting structures such as steel teeth may be used as the cutting structure on the cone cutter 14.

The body of the bit 10 includes an upper threaded portion that allows the bit 10 to be connected to the lower end of a rotary drill string (not shown). The bit 10 also includes a central passageway extending along the central axis of the bit to allow drilling fluid to enter from the upper section of the drill string (not shown) immediately above and pass downward to the bottom of the well bore to flush cuttings and drilling debris from the well bore.

A plurality of bearing systems are located in the bearing area between the cutter 14 and the bearing pin 18. The bearing systems in the bearing area include an outer friction bearing 19, a series of ball bearings 20, an inner friction bearing 21, and a thrust button 22. An O-ring seal 23 is positioned between the cutter 14 and the bearing pin 18. This seal retains lubricant in the bearing area around the bearing systems and prevents any materials in the well bore from entering the bearing area. A passageway 24 allows the balls that make up the ball bearing system 20 to be inserted into position after the cone cutter 14 is placed on the bearing pin 18. The series of ball bearings 20 serves to lock the cone cutter 14 on bearing pin 18. After the balls are in place, a plug 25 is inserted into the passageway 24 and welded therein by weld 26. Plug 25 has a reduced diameter throughout the major portion of its length to allow lubricant to flow through the passageway 24.

A cylindrical reservoir chamber 26 is located in the bit body 11. A lubricant reservoir 27 containing a suitable lubricant is positioned in the lubricant reservoir chamber 26. The lubricant reservoir 27 consists of a lubricant reservoir canister 28 with a flexible diaphragm 29 attached. A vent passage 30 allows the pressure of the fluid in the borehole to be transmitted to the outside of the flexible diaphragm 29. A passage 31 extends from the lubricant reservoir 27 to the bearing area between the cutter 14 and the bearing pin 18. A return passage 35 extends from the passage 24 to the lubricant reservoir 27. Lubricant in the bearing area between the cutter 14 and the bearing pin 18 can flow through the passage 24 into the passage 35 back to the lubricant reservoir 27. The opening 34 allows the lubricant to enter passage 24. Lubricant in the lubricant reservoir 27 can flow through the passage 31 to the bearing area.

The present invention provides a system for circulating lubricant from the lubricant reservoir 27 to the bearing area. The lubricant in the prior art bearings deteriorates and does not furnish proper lubrication. By circulating the lubricant from the reservoir 27 to the bearing area, the life of the lubricant will be increased by exposing a larger amount of lubricant to the bearing surfaces. The present invention provides spiral groove system cut in the bearing element 19 of the cone cutter 14 that operates as a ram or viscous pump when rubbing against the corresponding bearing surface of the bearing pin 18. The passage 31 is provided from the reservoir 27 to the pilot pin area and the return passage 35 is provided from the bearing surface to the reservoir 27.

Figure 2:
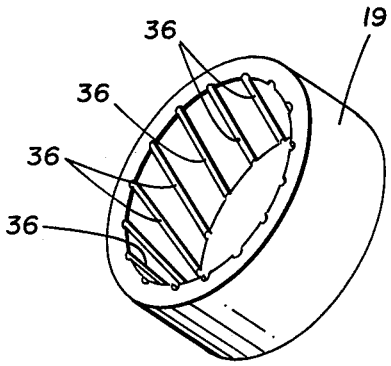
FIG. 2 is a view of the outer bearing element of the cone cutter of the bit shown in FIG. 1.

Referring now to FIG. 2, a view of bearing element 19 of the cone cutter 14 is provided to illustrate the ram pump or viscous pump action provided by the rotation of the cone cutter 14 upon bearing pin 18. The annular bearing element 19 in the cone cutter 14 includes a series of grooves 36. These grooves provide a pumping action as the cone cutter 14 rotates on the bearing pin 18. The grooves are approximately $\frac{1}{8}''$ wide and 3/64" deep. The grooves are positioned approximately $27\frac{1}{2}°$ apart and extend at roughly a 30° angle through the bearing element 19.

Figure 3:
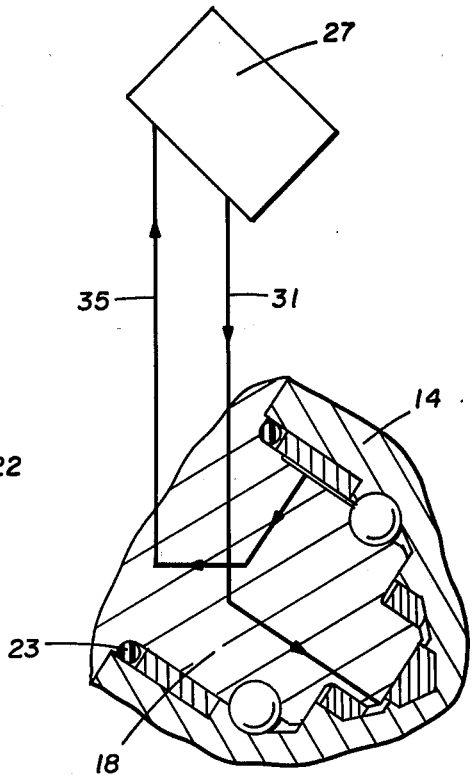
FIG. 3 is a schematic diagram of the lubricant circulation system of the present invention.

The structural details of an earth boring bit 10 constructed in accordance with the present invention having been described, the operation of the bit 10 will now be considered with reference to FIG. 3. The lubrication system of the bit 10 is filled with a suitable lubricant. The bit is rotated and thrust downward, thrusting the cutter 14 against the earth formations. Continued rotation with the drill string applying a thrust force to the bit 10 causes the cutters to disintegrate the formations and form the desired borehole. Lubricant is circulated from the lubricant reservoir 27 to the bearings of the bit and back to the lubricant reservoir 27 by the lubricant circulation system operated by rotation of the cone cutter 14 upon the bearing pin 18 of the bit. The seal 23 is positioned between the rolling cone cutter 14 and the bearing pin 18 of the bit to maintain lubricant in the bearing area and to prevent fluid in the borehole from entering the bearing area. The first passage 31 connects the lubricant reservoir 27 with the bearing area to channel lubricant from the lubricant reservoir to the bearing area. The second passage 35 extends from the bearing area to the lubricant reservoir 27 to allow lubricant to be channeled back to the lubricant reservoir. The spiral groove system in the bearing element 19 of the cone cutter 14 operates as a viscous or ram pump when rotating against the bearing pin 18 providing a pumping action to circulate lubricant from the lubricant reservoir 27 through said first passage 31 to the bearing area and from the bearing area through said second passage 35 back to said lubricant reservoir 27.

Figure 4:
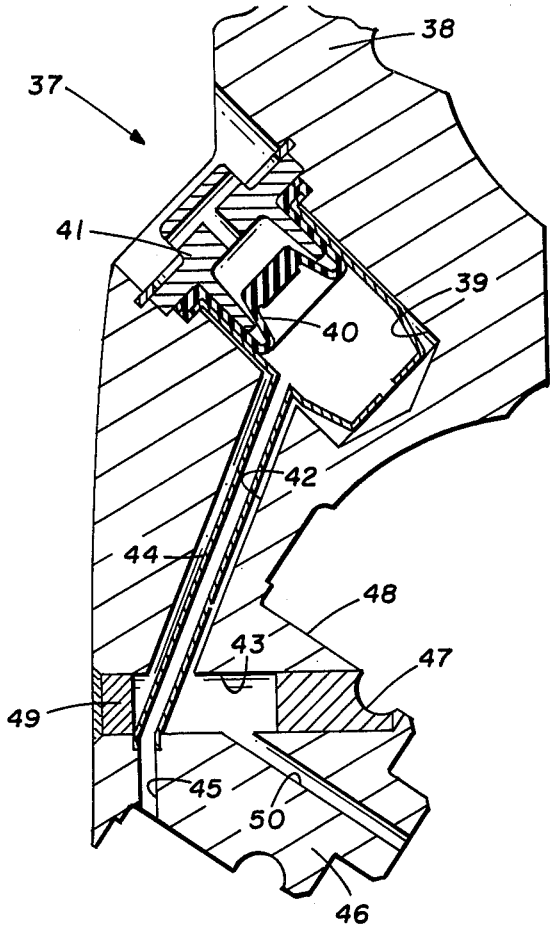
FIG. 4 is a sectional view of one arm of an earth boring bit constructed in accordance with the present invention.

Referring now to FIG. 4, a sectional view of one arm of another embodiment of a three cone rotary rock bit 37 incorporating the present invention is shown. It is to be understood that the structures of the other two arms are substantially identical to the arm shown in FIG. 4. A cutter is rotatably positioned on the journal portion or bearing pin 46 of the arm and adapted to disintegrate the earth formations as the bit 37 is rotated. The body of the bit 37 includes an upper threaded portion that allows the bit to be connected to the lower end of a rotary drill string (not shown). The bit also includes a central passageway extending along the central axis of the bit to allow drilling fluid to enter from the upper section of the drill string (not shown) immediately above and pass downward to the bottom of the well bore to flush cuttings and drilling debris from the well bore.

A plurality of bearing systems are located in the bearing area between the cutter and the bearing pin. The bearing systems in the bearing area include an outer friction bearing 48, a ball bearing system 47, an inner friction bearing, and a thrust button. An O-ring seal is positioned between the cutter and the bearing pin. This seal retains lubricant in the bearing area around the bearing systems and prevents any materials in the well bore from entering the bearing area. A passageway 43 allows the balls that make up the ball bearing system to be inserted into position after the cone cutter is placed on the bearing pin. The series of ball bearings serves to lock the cone cutter on the bearing pin. After the balls are in place, a plug is inserted into the passageway 43 and welded therein.

A cylindrical reservoir chamber 39 is located in the bit body. A lubricant reservoir containing a suitable lubricant is positioned in the lubricant reservoir chamber 39. The lubricant reservoir consists of a lubricant reservoir canister 41 with a flexible diaphragm 40 attached. A vent allows the pressure of the fluid in the borehole to be transmitted to the outside of the flexible diaphragm 40. Passages 42 and 50 extend from the lubricant reservoir to the bearing area between the cutter and the bearing pin 46. A return passage 44 extends inside the passage 42 from the bearing area to the lubricant reservoir. Lubricant in the bearing area between the cutter and the bearing pin can flow through the passage 44 back to the lubricant reservoir. The lubricant return hole 45 allows the lubricant to enter passage 44. Lubricant in the lubricant reservoir can flow through the passages 42 and 50 to the bearing area.

Figure 5:
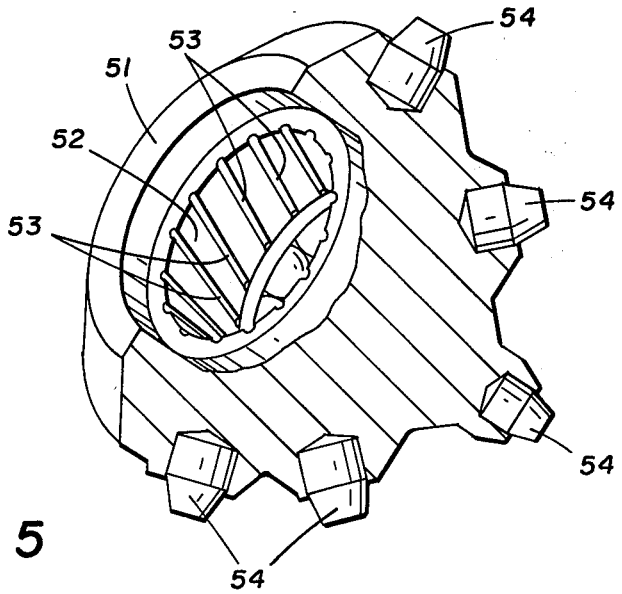
FIG. 5 shows the cone cutter that is mounted upon the arm shown in FIG. 4.

Referring now to FIG. 5, a view of a cone cutter 51 to be mounted on bearing pin 46 is provided to illustrate the ram pump or viscous pump action provided by the rotation of the cone cutter 51. The annular bearing element 52 in the cone cutter 51 includes a series of grooves 53. These grooves provide a pumping action as the cone cutter 51 rotates on the bearing pin 46. The grooves are approximately ⅛" wide and 3/64" deep. The grooves are positioned approximately 27½° apart and extend at roughly a 30° angle through the bearing element 52. The cutting structure 54 on the surface of cutter 51 contacts and disintegrates the formations in a manner that is well known in the art.

The structural details of another embodiment of an earth boring bit 37 constructed in accordance with the present invention having been described, the operation of the bit 37 will now be considered with reference to FIGS. 4 and 5. The present invention provides a system for circulating the lubricant from the lubricant reservoir to the bearing area. The lubricant in the prior art system tends to deteriorate and does not furnish proper lubrication. By circulating the lubricant from the reservoir to the bearing area, the life of the lubricant will be increased by exposing a larger amount of lubricant to the bearing surfaces. The lubrication system of the bit 37 is filled with a suitable lubricant. The bit is rotated and thrust downward, thrusting the cutter 51 against the earth formations. Continued rotation with the drill string applying a thrust force to the bit 37 causes the cutters to disintegrate the formations and form the desired borehole. Lubricant is circulated from the lubricant reservoir to the bearings of the bit and back to the lubricant reservoir by the lubricant circulation system operated by rotation of the cone cutter 51 upon the bearing pin 46 of the bit. The seal is positioned between the rolling cone cutter and the bearing pin of the bit to maintain lubricant in the bearing area and to prevent fluid in the borehole from entering the bearing area. The first passage 42 connects the lubricant reservoir with the bearing area to channel lubricant from the lubricant reservoir to the bearing area. The second passage 44 extends from the bearing area to the lubricant reservoir to allow lubricant to be channeled back to the lubricant reservoir. The spiral groove system in the bearing element 52 of the cone cutter operates as a viscous or ram pump when rotating against the bearing pin 46 providing a pumping action to circulate lubricant from the lubricant reservoir through said first passage to the bearing area and from the bearing area through said second passage back to said lubricant reservoir.

The embodiments of the invention in which an exclusive property or privilege is claimed are defined as follows:

1. In an earth boring bit including a bit body with a bearing shaft connected to said bit body, a rotatable cutter mounted upon said bearing shaft, bearing means and seal means between said bearing shaft and said cutter, the improvement comprising:
   - a lubricant circulation system including a lubricant reservoir in said bit body;
   - first passage means for channeling lubricant from said lubricant reservoir to said bearing means;
   - second passage means for channeling lubricant from said bearing means to said lubricant reservoir; and
   - viscous pump means for pumping lubricant through said first and second passage means, said viscous pump means including
     - an annular bearing element positioned between said bearing shaft and said rotatable cutter, said annular bearing element having
     - an inner surface that rotates on said bearing shaft with
     - a multiplicity of grooves in said inner surface of said annular bearing element, said grooves extending angularly along said inner surface of said annular bearing element.

2. In an earth boring bit, said earth boring bit including a bit body having a bearing pin, a rotatable cutter, bearing means for promoting rotation of said cutter and a seal between said rotatable cutter and said bit body, a lubricant circulation system, comprising:
   - a lubricant reservoir in said bit body;
   - passage means for channeling lubricant from said lubricant reservoir to said bearing means and from said bearing means to said lubricant reservoir; and
   - viscous pump means for circulating lubricant through said passage means, said viscous pump means including an annular bearing element positioned between said bearing pin and said rotatable cutter, said bearing element having an inner surface that rotates on said bearing pin with a series of grooves in said inner surface of said annular bearing element, said grooves extending angularly along said inner surface of said annular bearing element for providing a pumping force for circulating lubricant through said passage means as said rotatable cutter rotates on said bearing pin.

3. In an earth boring bit including a bit body with a bearing pin extending from said bit body, a rotatable cutter mounted to rotate about said bearing pin, bearing means and seal means between said bearing pin and said cutter, the improvement comprising:

a lubricant circulation system including a lubricant reservoir in said bit body;

first passage means for channeling lubricant from said lubricant reservoir to said bearing means;

second passage means for channeling lubricant from said bearing means to said lubricant reservoir; and viscous pump means for circulating lubricant through said first and second passage means, said viscous pump means including an annular bearing element in said rotatable cutter positioned to contact and rotate about said bearing pin with said annular bearing element having an inner surface and a series of grooves in said inner surface of said annular bearing element that pump lubricant through said first and second passage means as said rotatable cutter rotates about said bearing pin, said series of grooves extending roughly at a 30° angle through said inner surface of said annular bearing element.

* * * * *